US009908256B2

(12) United States Patent
Sinzig et al.

(10) Patent No.: US 9,908,256 B2
(45) Date of Patent: Mar. 6, 2018

(54) CUTTING-DEPTH LIMITING DEVICE

(71) Applicant: Robert Bosch GmbH, Stuttgart (DE)

(72) Inventors: Bruno Sinzig, Oberbipp (CH); Christian Ackermann, Solothurn (CH); Laurent Gribi, Büren an der Aare (CH)

(73) Assignee: Robert Bosch GmbH, Stuttgart (DE)

( * ) Notice: Subject to any disclaimer, the term of this patent is extended or adjusted under 35 U.S.C. 154(b) by 217 days.

(21) Appl. No.: 14/413,724

(22) PCT Filed: May 29, 2013

(86) PCT No.: PCT/EP2013/061005
§ 371 (c)(1),
(2) Date: Jan. 9, 2015

(87) PCT Pub. No.: WO2014/009052
PCT Pub. Date: Jan. 16, 2014

(65) Prior Publication Data
US 2015/0158198 A1 Jun. 11, 2015

(30) Foreign Application Priority Data
Jul. 9, 2012 (DE) ..... 10 2012 211 942

(51) Int. Cl.
*B27B 9/02* (2006.01)

(52) U.S. Cl.
CPC ..... *B27B 9/02* (2013.01)

(58) Field of Classification Search
CPC .. B27B 9/02; B27B 5/182; B27B 5/20; B27B 5/185; B27B 5/187; B27B 5/188; B27B 5/203; B27B 5/206; B27B 5/207; B27B 9/00
See application file for complete search history.

(56) References Cited

U.S. PATENT DOCUMENTS

| | | | |
|---|---|---|---|
| 4,856,394 | A | 8/1989 | Clowers |
| 2002/0059731 | A1 | 5/2002 | Zeiler et al. |

FOREIGN PATENT DOCUMENTS

| | | | |
|---|---|---|---|
| CN | 201483580 | U | 5/2010 |
| CN | 102548720 | A | 7/2012 |
| DE | 20 2010 013 185 | U1 | 6/2011 |
| GB | 2 340 443 | A | 2/2000 |
| JP | 2003-291102 | A | 10/2003 |
| JP | 2003291102 | A * | 10/2003 |

OTHER PUBLICATIONS

International Search Report corresponding to PCT Application No. PCT/EP2013/061005, dated Oct. 2, 2013 (German and English language document) (5 pages).

* cited by examiner

*Primary Examiner* — Jonathan Riley
*Assistant Examiner* — Liang Dong
(74) *Attorney, Agent, or Firm* — Maginot, Moore & Beck LLP

(57) ABSTRACT

A cutting-depth limiting device for portable power tools includes at least one cutting-depth guide unit and at least one stop unit. The stop unit has at least one movably mounted stop element, and at least one fixing element configured to fix the stop element in at least one position. The stop unit further has at least one pre-positioning element which is configured to exert a force on the fixing element in a direction of a releasing position of the fixing element.

8 Claims, 3 Drawing Sheets

CUTTING-DEPTH LIMITING DEVICE

This application is a 35 U.S.C. § 371 National Stage Application of PCT/EP2013/061005, filed on May. 29, 2013, which claims the benefit of priority to Serial No. DE 10 2012 211 942.6, filed on Jul. 9, 2012 in Germany, the disclosures of which are incorporated herein by reference in their entirety.

Cutting-depth limiting devices for portable power tools are already known, which devices have a cutting-depth guide unit and a stop unit, wherein the stop unit has a movably mounted stop element and at least one fixing element for fixing the stop element in at least one position.

SUMMARY

The disclosure is based on a cutting-depth limiting device for portable power tools, having at least one cutting-depth guide unit and having at least one stop unit, which latter has at least one movably mounted stop element and at least one fixing element for fixing the stop element in at least one position.

It is proposed that the stop unit comprises at least one prepositioning element, which, in at least one state, subjects the fixing element to a force in the direction of a release position of the fixing element. Preferably, the prepositioning element, at least in a state of the stop element which is unburdened by a power tool housing of the portable power tool, impinges on the fixing element. The prepositioning element here impinges on the fixing element preferably in a direction facing away from a guide element of the cutting-depth guide unit. Preferably, the prepositioning element subjects the fixing element to a force in the direction of the power tool housing. The expression "cutting-depth limiting device" is here intended to define a device which is designed to limit an intrusion distance of a machining tool (in particular a circular saw blade) connected to a tool holder of a portable power tool into a workpiece to be machined, and/or to set a length of the intrusion distance, in particular by means of the stop unit. By "designed" should here be understood, in particular, especially devised and/or especially equipped. The intrusion distance of the machining tool into a workpiece to be machined is here viewed, in particular, along a direction running at least substantially perpendicular to a bearing surface of a bearing unit of the portable power tool, with which bearing surface the portable power tool rests on a workpiece surface of a workpiece to be machined. The expression "substantially perpendicular to" is here intended to define, in particular, an orientation of a direction relative to a reference direction, wherein the direction and the reference direction, viewed, in particular, in one plane, form an angle of 90° and the angle has a maximum deviation of, in particular, less than 8°, advantageously less than 5°, and particularly advantageously less than 2°.

The expression "cutting-depth guide unit" is here intended to define a unit which is designed to guide a component in a movement along a predefined path, by means of an influence of at least one constraining force, transversely to a motional direction. By a "constraining force" should here be understood, in particular, a force which is designed to prevent a component from moving in at least one direction and/or to keep the component, in the course of a movement, on a path predefined by means of an influence of the force on the component. Preferably, by means of a cooperation of the cutting-depth guide unit and the stop unit, a motional distance of the tool holder and/or of the power tool housing in the direction of the bearing unit is limited relative to the bearing unit and/or a length of the motional distance of the tool holder and/or of the power tool housing in the direction of the bearing unit is set relative to the bearing unit. Preferably, by means of a setting of a position of the stop element relative to the guide element, a length of the motional distance of the tool holder and/or of the power tool housing in the direction of the bearing unit can be set relative to the bearing unit. Preferably, by means of a setting of a length of the motional path of the tool holder, in particular with a machining tool attached thereto, and/or of the power tool housing relative to the bearing unit, a cutting depth of a machining tool which, in a machining of a workpiece, penetrates into a workpiece surface, can be set. By a "bearing unit" should here be understood, in particular, a unit which, during machining of a workpiece by means of the portable power tool, given regular and proper handling of the portable power tool, rests on the workpiece, in particular with a bearing surface of the bearing unit. Preferably, the bearing unit is designed to support the portable power tool on the workpiece during machining of the workpiece. Particularly preferably, the bearing unit is configured as a sliding shoe and/or as a base plate.

By the expression "movably mounted" should here be understood, in particular, a mounting of the stop element on the guide element, wherein the stop element, in particular decoupled from an elastic deformation of the stop element, has a freedom of movement relative to the cutting-depth guide unit along at least one axis along a distance greater than 1 mm, preferably greater than 10 mm, and particular preferably greater than 20 mm. It is also conceivable, however, for the stop element to alternatively or additionally have a different freedom of movement which appears sensible to a person skilled in the art, in particular relative to the guide element, such as, for instance, a freedom of movement about at least one axis through an angle greater than 10°, preferably greater than 20°, and particularly preferably greater than 30°. Preferably, the motional axis of the stop element runs at least substantially parallel, or at least substantially transversely to a cutting-depth guide path of the guide element. Preferably, the stop element is movably mounted relative to the guide element. By "substantially parallel" should here be understood, in particular, an orientation of a direction relative to a reference direction, in particular in one plane, wherein the direction in relation to the reference direction has a deviation in particular less than 8°, advantageously less than 5°, and particularly advantageously less than 2°, and, in particular, is identical with the reference direction. The expression "at least substantially transversely to" is here intended to define, in particular, an orientation of a direction relative to a reference direction, wherein the direction and the reference direction, in particular viewed in one plane, have mutually different courses and, in particular, are also different from purely opposite courses of the direction and reference direction.

The fixing element is preferably configured as a positive-locking fixing element. Particularly preferably, the fixing element is configured as a locking lever projection. It is also conceivable, however, for the fixing element to have a different configuration which appears sensible to the person skilled in the art, such as, for instance, a configuration as a latching recess, which cooperates with a corresponding latching projection. Preferably, the fixing element is configured in one piece with the stop element. By "in one piece" should be understood, in particular, at least integrally bonded, for instance by a welding process, a gluing process, an injection molding process, and/or a different process which appears sensible to a person skilled in the art, and/or advantageously formed in one piece, such as, for instance, by manufacture from a casting and/or by manufacture in a single-component or multi-component injection molding process, and advantageously from a single blank. The fixing element configured as a locking lever projection cooperates in at least one position, for fixing of the stop element in at least one position relative to the guide element, with at least one latching path of the guide element. Preferably, the fixing element, in particular in a blocking position of the fixing element, fixes the stop element at least in one position relative to the guide element. The expression "release position" is here intended to define, in particular, a position of the fixing element in which the fixing element is disengaged from a counter-fixing element corresponding with the fixing element, and/or in which the fixing element is contactless to a counter-fixing element corresponding with the fixing element. Preferably, the stop element, in the release position of the fixing element, is movable relative to the guide element for setting of a cutting depth. By means of the disclosed configuration of the cutting-depth limiting device, a comfortable adjustability of a desired cutting depth by means of a movement of the stop element can advantageously be achieved. Moreover, an automatic engagement function of the fixing element for fixing of the stop element in at least one position relative to the guide element can advantageously be realized in consequence of a movement of the power tool housing in the direction of the stop element. The fixing element is here advantageously moved, by a movement of the power tool housing in the direction of the fixing element or by a force effect of the power tool housing on the fixing element, into a blocking position of the fixing element, in which the fixing element fixes the stop element in at least one position relative to the guide element.

It is further proposed that the prepositioning element, in at least one state, moves the fixing element away from at least one latching path of the guide element of the cutting-depth guide unit. Preferably, the prepositioning element, at least in a state of the stop element which is unburdened by the power tool housing of the portable power tool, moves the fixing element away from the latching path of the guide element. Preferably, the prepositioning element, in consequence of a lifting of a force effect of the power tool housing on the fixing element, moves the fixing element away from a latching path of the guide element. As a result, an automatic transfer of the fixing element, starting from a blocking position of the fixing element, into a release position of the fixing element can advantageously be achieved. Advantageously, a comfortable setting of a desired cutting depth, which is decoupled from a separate operation of the fixing element in order to achievement mobility of the stop element relative to the guide element, can advantageously be achieved.

It is further proposed that the prepositioning element is movably mounted relative to the stop element. During a movement of the stop element, a cooperation of the prepositioning element with a counter-positioning element corresponding with the prepositioning element can advantageously be ensured. Thus a reliable prepositioning of the stop element can advantageously be achieved.

In a preferred embodiment of the cutting-depth limiting device, the stop element comprises at least one receiving recess, in which the prepositioning element is at least partially disposed. Advantageously, a compact arrangement of the prepositioning element can be achieved. Thus installation space can advantageously be saved and a compact cutting-depth limiting device can be achieved.

It is additionally proposed that the prepositioning element is configured as a spring-loaded latching pin. To this end, the stop unit comprises at least one spring element, which subjects the prepositioning element to a spring force, in particular to a spring force in a direction facing away from the stop element. By a "spring element" should be understood, in particular, a macroscopic element which has at least one extent that, in a normal operating state, is elastically variable by at least 10%, in particular by at least 20%, preferably by at least 30%, and particularly advantageously by at least 50%, and which, in particular, generates a counter-force that is dependent on a change in the extent and is preferably proportional to the change and that opposes the change. By an "extent" of an element should be understood, in particular, a maximum spacing of two points of a perpendicular projection of the elements onto a plane. By a "macroscopic element" should be understood, in particular, an element having an extent of at least 1 mm, in particular of at least 5 mm, and preferably of at least 10 mm. Preferably, the spring element is configured as a compression spring. It is also conceivable, however, for the spring element to have a different configuration which appears sensible to a person skilled in the art. Preferably, the spring element is disposed in the receiving recess of the stop element. By means of the disclosed configuration, a constructively simple prepositioning element of the stop element in at least one position relative to the guide element can advantageously be achieved. Moreover, for a secure prepositioning of the stop element, the prepositioning element can advantageously be subjected by means of the spring element to a spring force in the direction of a counter-positioning element corresponding with the prepositioning element. In addition, a force which impinges on the fixing element, in at least one operating state, in the direction of a release position of the fixing element can be generated in a constructively simple manner.

It is further proposed that the stop element is pivotably mounted on a control element of the stop unit, which control element is movably mounted on a guide element of the cutting-depth guide unit. The term "control element" is intended, in particular, to define an element which is designed to, in an operating procedure, receive an input variable from an operator and, in particular, be contacted directly by an operator, wherein a touching of the control element is sensed, and/or an actuating force exerted on the control element is sensed, and/or is mechanically relayed for the actuation of a unit and/or of an element, in particular of the stop element. A comfortable operability of the stop element can advantageously be achieved.

It is further proposed that the stop unit, for a movement of the stop element, comprises at least the control element, which is displaceably mounted in a guide recess of the guide element of the cutting-depth guide unit. Particularly preferably, on the control element is arranged at least one display element of the stop unit. The display element is preferably designed to indicate to an operator, by means of a scale disposed on the guide element, a limitation of a cutting depth, which limitation is set by means of the cutting-depth limiting device. It is also conceivable, however, for the display element to be configured as a digital display, by means of which a set limitation of a cutting depth can be represented. By means of the disclosed configuration of the cutting-depth limiting device, a precise setting of a desired cutting depth can advantageously be achieved.

Preferably, the guide recess is disposed in a plane running at least substantially perpendicular to a motional axis of the stop element. It is also conceivable, however, for the guide recess to be disposed in a different plane which appears sensible to a person skilled in the art. By means of the disclosed configuration of the cutting-depth limiting device, a comfortable operability of the control element can advantageously be achieved.

It is additionally proposed that the cutting-depth guide unit comprises at least the guide element, which guide element has at least one latching path, with which at least the prepositioning element cooperates in at least one position. Preferably, the prepositioning element, in at least one position, engages in the latching path. Particularly preferably, the guide element has at least one further latching path, in which the fixing element, at least in a blocking position, engages. It is also conceivable, however, for the guide element to have only one latching pat, in which the prepositioning element, in at least one position, engages and in which the fixing element, at least in a blocking position of the fixing element, engages. By means of the disclosed configuration, a secure prepositioning and/or fixing of the stop element relative to the guide element can advantageously be achieved.

The disclosure is further based on a portable power tool, in particular a circular saw, comprising a cutting-depth limiting device according to the disclosure. By a "portable power tool" should here be understood, in particular, a power tool for machining of workpieces, which power tool can be transported without a transport machine by an operator. The portable power tool has, in particular, a mass which is less than 40 kg, preferably less than 10 kg, and particularly preferably less than 5 kg. The portable power tool is particularly preferably configured as a plunge-cut circular saw. It is also conceivable, however, for the portable power tool to have a different configuration which appears sensible to a person skilled in the art, such as, for instance, an embodiment as a plunge saw, as an electric hand saw, etc. High ease of operation for an operator of the portable power tool can advantageously be achieved.

The cutting-depth limiting device according to the disclosure and/or the portable power tool according to the disclosure should not here be limited to the above-described application and embodiment. In particular, for the fulfillment of a herein described working method, the cutting-depth limiting device according to the disclosure and/or the portable power tool according to the disclosure can have a number of individual elements, components and units which deviates from a number stated herein.

BRIEF DESCRIPTION OF THE DRAWINGS

Further advantages emerge from the following drawing description. In the drawing, an illustrative embodiment of the disclosure is represented. The drawing, the description and the claims contain numerous features in combination. The person skilled in the art will expediently also view the features individually and group them into sensible further combinations.

In the drawing.

DETAILED DESCRIPTION

Figure 1:
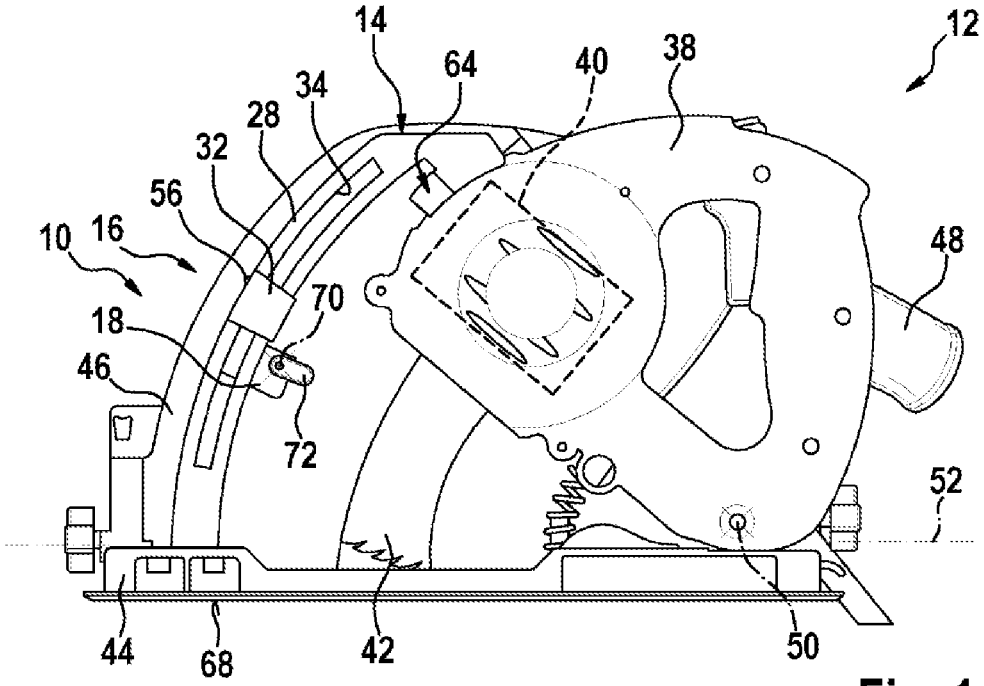
FIG. 1 shows in a schematic representation a portable power tool according to the disclosure, having a cutting-depth limiting device according to the disclosure.

FIG. 1 shows a portable power tool 12 configured as a plunge-cut circular saw and having a cutting-depth limiting device 10. The portable power tool 12 further comprises a power tool housing 38, which is designed to enclose a drive unit 40 of the portable power tool 12. The drive unit 40 comprises a drive shaft (not represented in detail here) for a drive of a machining tool 42 couplable to a tool holder (not represented in detail here) of the portable power tool 12 (FIGS. 1 and 3), in a manner already known to a person skilled in the art. The portable power tool 12 further comprises a bearing unit 44, configured as a base plate or as a sliding shoe, with which the portable power tool 12, in a machining of a workpiece (not represented in detail here), rests on a workpiece surface of the workpiece or, in a movement for introducing a cut into the workpiece, slides on the workpiece surface. On the bearing unit 44 there is also arranged a protection unit 46 of the portable power tool 12, which protects an operator from injuries as the workpiece is machined by means of the machining tool 42. The protection unit 46 is here configured as a protective hood, which encloses the machining tool 42, in a mounted state, along a rotational direction of the drive shaft through more than 160°. The protection unit 46 further has an extraction coupling element 48, which is connectable to an extraction unit (not represented in detail here) for extracting removed workpiece particles during machining of the workpiece. The power tool housing 38 is pivotably mounted relative to the bearing unit 44 on the protection unit 46. The power tool housing 38 is here mounted, in a manner already known to a person skilled in the art, pivotably about a plunge pivot axis 50 of the power tool housing 38. In addition, the power tool housing 38 is mounted together with the protection unit 46, in a manner already known to a person skilled in the art, on the bearing unit 44 pivotably about a tilt pivot axis 52 relative to the bearing unit 44. The plunge pivot axis 50 extends at least substantially perpendicular to the tilt pivot axis 52.

The cutting-depth limiting device 10 for the portable power tool 12 is disposed on the protection unit 46, for setting of a limitation of a cutting depth, on a side of the protection unit 46 which is facing toward the power tool housing 38. It is also conceivable, however, for the cutting-depth limiting device 10 to be disposed at a different position, which appears sensible to a person skilled in the art, on the protection unit 46 or on another component of the portable power tool 12. The cutting-depth limiting device 10 comprises at least one cutting-depth guide unit 14 and at least one stop unit 16, which latter has at least one movably mounted stop element 18 and at least one fixing element 20 for fixing the stop element in at least one position. The stop element 18 is here mounted, for setting of a limitation of a cutting depth of the machining tool 42, movably along a guide element 28 of the cutting-depth guide unit 14.

The stop unit 16 comprises, for a movement of the stop element 18, at least one control element 32, which is displaceably mounted in a guide recess 34 of the guide element 28 of the cutting-depth guide unit 14. The stop element 18 is pivotably mounted about a motional axis 36 of the stop element 18 on the control element 32 of the stop unit 16, which control element is movably mounted on the guide element 28 of the cutting-depth guide unit 14. The guide recess 34 is disposed in a plane running at least substantially perpendicular to the motional axis 36 of the stop element 18. The guide recess 34, viewed along a total extent of the guide recess 34, here has an arc-shaped course. It is also conceivable, however, for the guide recess 34 to be disposed at a different position, which appears sensible to a person skilled in the art, on the guide element 28, such as, for instance on a side of the guide element 28 etc. which is facing away from the power tool housing 38. Moreover, it is likewise conceivable for the guide recess 34 to have a different course which appears sensible to a person skilled in the art, such as, for instance, a rectilinear course, etc.

Figure 2:
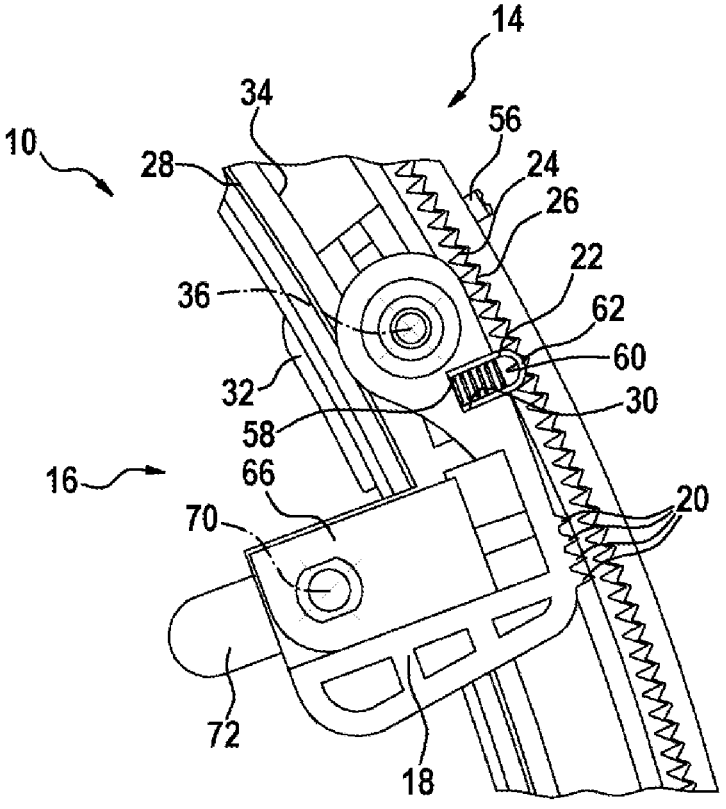
FIG. 2 shows in a schematic representation a detailed view of the cutting-depth limiting device according to the disclosure, having a stop element, situated in a prepositioned state, of a stop unit of the cutting-depth limiting device according to the disclosure.
Figure 4:
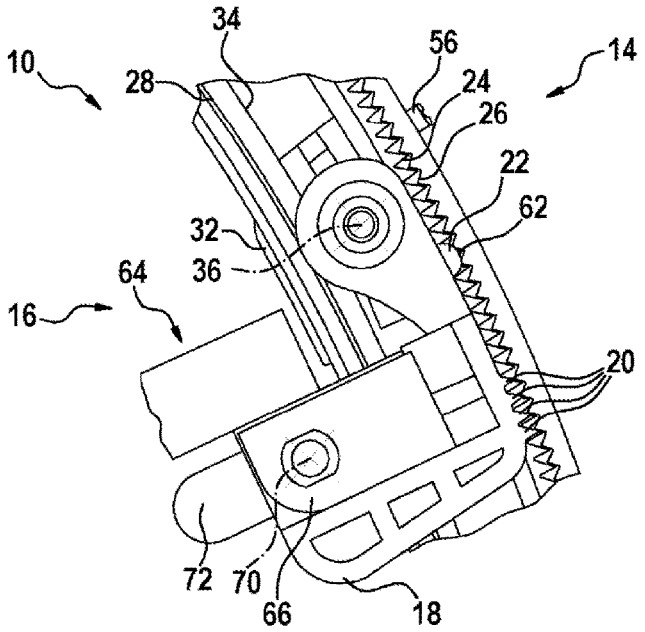
FIG. 4 shows in a schematic representation a detailed view of the cutting-depth limiting device according to the disclosure, having the stop element, situated in a fixed state, of the stop unit.

Furthermore, the guide element 28 comprises at least one latching path 24, which is configured in correspondence with the fixing element 20. The latching path 24 is here configured as a sawtooth latching path (FIGS. 2 and 4). It is also conceivable, however, for the latching path 24 to have a different configuration which appears sensible to a person skilled in the art, such as, for instance, a configuration as a latching rail, which has a multiplicity of holes into which a fixing element, constructed as a bolt, can be introduced. The guide element 28 also comprises at least one further latching path 26, which is designed to cooperate with a prepositioning element 22 of the stop unit 16 for prepositioning of the stop element 18 (FIGS. 2 and 4). The cutting-depth guide unit 14 thus comprises at least one guide element 28, which has at least one further latching path 26, with which at least the prepositioning element 22, in at least one position, cooperates. The prepositioning element 22 is here disposed on the stop element 18. The further latching path 26 is configured as a triangular toothed latching path, wherein individual teeth of the further latching path 26 are configured as isosceles triangles.

Figure 5:
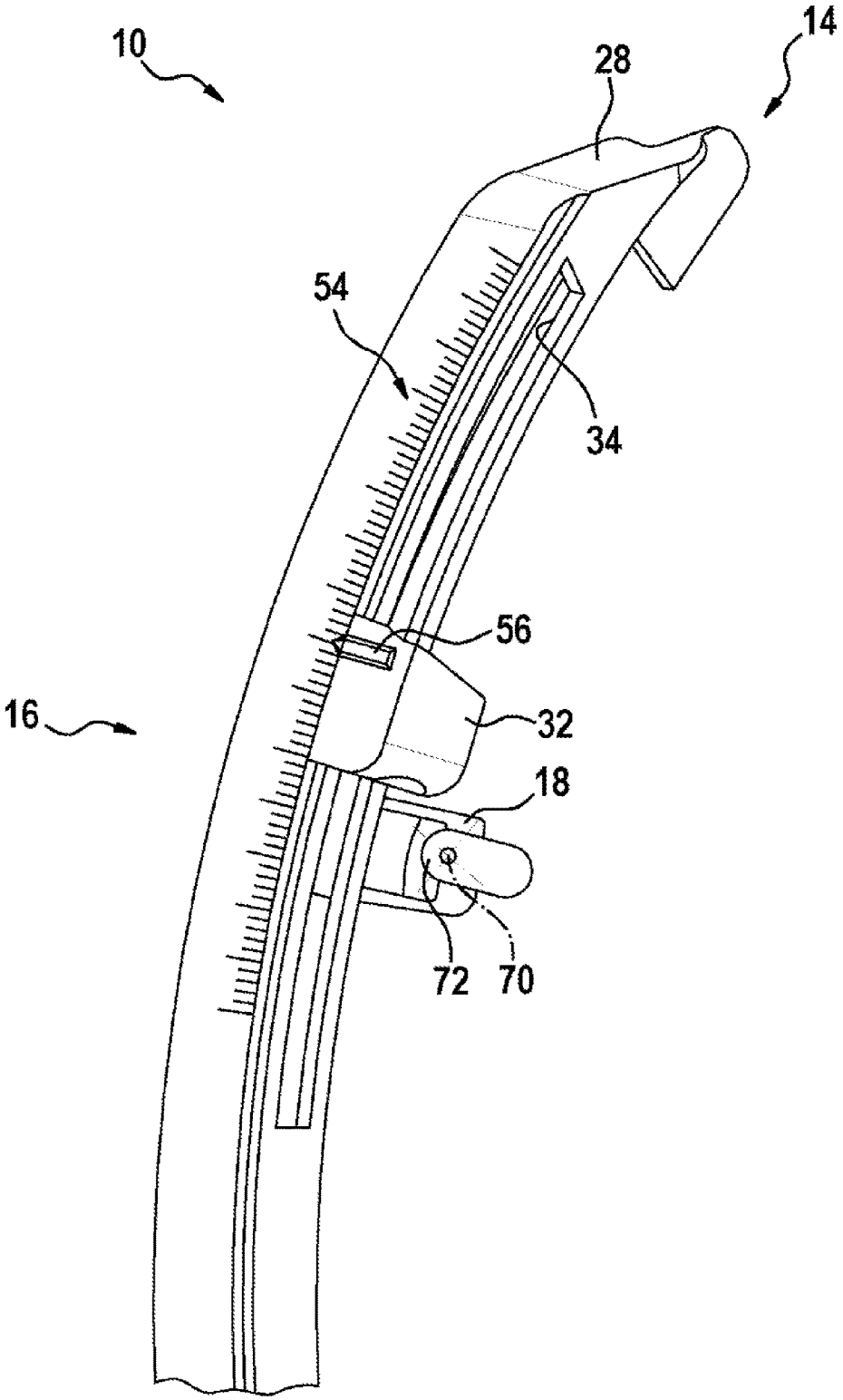
FIG. 5 shows in a schematic representation a detailed view of the stop unit disposed on a cutting-depth guide unit of the cutting-depth limiting device according to the disclosure.

The latching path 24 and the further latching path 26 run on a side facing toward the power tool housing 38. The latching path 24 and the further latching path 26 here run at least substantially parallel. It is also conceivable, however, for the guide element 28 to have only a single latching path 24, which is designed to cooperate with the fixing element 20 and the prepositioning element 22. On a side of the guide element 28 which is facing away from the latching path 24 and the further latching path 26, the guide element has a measuring scale 54, which, in order to indicate a dimension of a cutting depth, which dimension corresponds to a limitation, set by means of the stop unit 16, of a cutting depth, cooperates with a pointer element 56 disposed on the control element 32 (FIG. 5). It is also conceivable, however, for the cutting-depth limiting device 10 to comprise a digital display unit for indicating a dimension of a cutting depth, which dimension corresponds to a set limitation of a cutting depth.

The fixing element 20 is configured as a locking projection. For fixing of the stop element 18 in at least one position relative to the guide element 28, the fixing element 20 is disposed on a side of the stop element 18 which is facing toward the guide element 28. The fixing element 20 is here configured in one piece with the stop element 18. The fixing element 20, viewed in a plane running at least substantially perpendicular to the motional axis 36 of the stop element 18, has a polygonal shape. In the plane running at least substantially perpendicular to the motional axis 36 of the stop element 18, the stop element 18 has a sawtooth shape. The fixing element 20 is configured in correspondence with the latching path 24 configured as a sawtooth latching path. In total, the stop unit 16 has at least four fixing element 20, which are configured as locking projections. The four fixing elements 20 have a mutually analogous configuration and are configured in one piece with the stop element 18.

The stop unit 16 further comprises at least the prepositioning element 22, which, in at least one state, subjects the fixing element 20 to a force in the direction of the release position of the fixing element 20. In at least one state, the prepositioning element 22 moves the fixing element 20 away from at least the latching path 24 of the guide element 28 of the cutting-depth guide unit 14. At least in a state of the stop element 18 which is unburdened by the power tool housing 38 of the portable power tool 12, the prepositioning element 22 hereupon moves the fixing element 20 away from the latching path 24 of the guide element 28. As a result, the fixing element 20 is transferred into a release position of the fixing element 20. In the release position of the fixing element 20, the stop element 18, for setting of a cutting depth, is movable relative to the guide element 28 by a movement of the control element 32 in the guide recess 34 along the guide recess 34.

The prepositioning element 22 is designed to secure the stop element 18 against movement along the latching path 24 or along the guide recess 34 in consequence of a weight force which acts on the stop element 18. To this end, the prepositioning element 22 is configured as a spring-loaded latching pin (FIGS. 2 and 4). The prepositioning element 22 is thus movably mounted relative to the stop element 18. For reception of the prepositioning element 22, the stop element 18 has at least one receiving recess 30, in which the prepositioning element 22 is at least partially disposed. For loading of the prepositioning element 22 with a force in the direction of the guide element 28 or in the direction of the further latching path 26, the stop unit 16 comprises at least one spring element 58 (FIGS. 2 and 4). The spring element 58 is configured as a helical compression spring. It is also conceivable, however, for the spring element 58 to have a different configuration which appears sensible to a person skilled in the art. The spring element 58 is disposed in the receiving recess 30 of the stop element 18. The spring element 58 is additionally disposed in a recess 60 of the prepositioning element 22. Thus the spring element 58 is supported by one end against the stop element 18, while by a further end the spring element 58 is supported against the prepositioning element 22. The stop element 18 is thus subjected by a spring force of the spring element 58, and by the cooperation of the prepositioning element 22 with the further latching path 26, to a force in a direction facing away from the guide element 28. Hence the fixing element 20, in at least one state, is also subjected to a force in the direction of a release position of the fixing element 20.

For mobility of the stop element 18 by a movement of the control element 32 in the guide recess 34 in a release position of the fixing element 20, the prepositioning element 22 has a semicircular latching head 62. The latching head 62 here cooperates with the further latching path 26. The latching head 62 is here impinged, by means of a spring force of the spring element 58, in the direction of the guide element 28 or of the further latching path 26. In the event of a movement of the stop element 18 resulting from a movement of the control element 32 in the guide recess 34, the latching head 62 can slide, due to overlatching, along the further latching path 26. The latching head 62 and the prepositioning element 22 are here forced, counter to a spring force of the spring element 58, in the direction of the stop element 18 into the receiving recess 30 of the stop element 18. As soon as a movement of the control element 32 is terminated, the prepositioning element 22 and the latching head 62 are brought by a spring force of the spring element 58 into engagement of at least two latching regions or of at least two latching teeth of the further latching path 26. It is thereby ensured that the stop element 18, following setting of a cutting depth, does not move out of the set position as a result of a weight force which acts on the stop element 18. Thus the stop element 18 is prepositioned by means of the prepositioning element 22.

Figure 3:
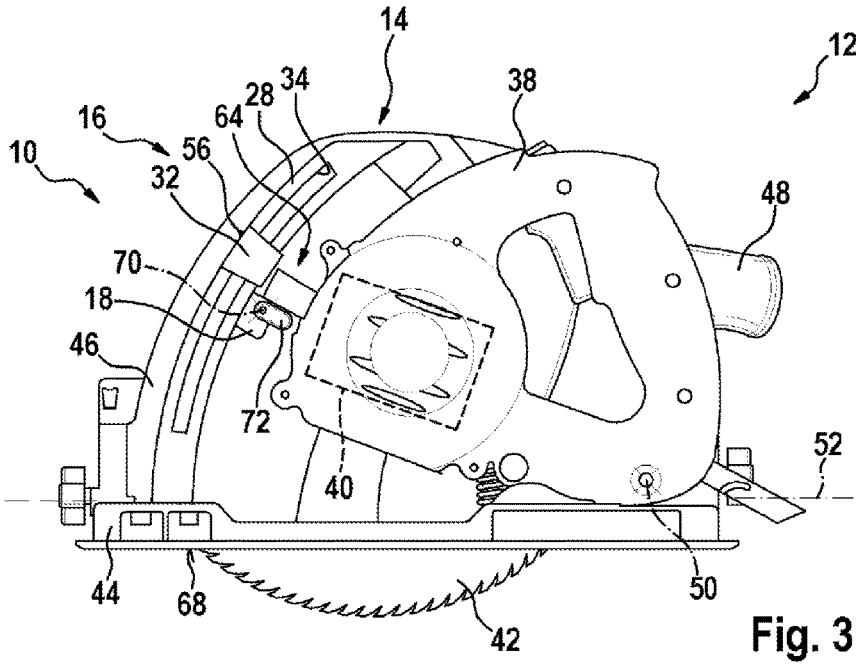
FIG. 3 shows in a schematic representation the portable power tool according to the disclosure, having a power tool housing situated in a state pivoted about a plunge pivot axis.

In a machining of a workpiece (not represented in detail here), following setting of a cutting depth by means of a positioning of the stop element 18, the power tool housing 38 is pivoted about the plunge pivot axis 50 relative to the bearing unit 44 in the direction of the bearing unit 44 (FIG. 3). Hence, for machining of the workpiece, cutting teeth of the machining tool 42 come into contact or engagement with the workpiece. The power tool housing 38 is pivoted about the plunge pivot axis 50 to the point where a stop region 64 of the power tool housing 38 abuts against the stop element 18. As a result, a torque, which pivots the stop element 18 about the motional axis 36 of the stop element 18 relative to the control element 32, is generated. In consequence of the pivot movement of the stop element 18 relative to the control element 32, the fixing element 20 enters into engagement with the latching path 24 or with latching teeth of the latching path 24. The fixing element 20 is thus in a blocking position, in which a movement of the stop element 18 along the guide recess 34 is prevented by cooperation of the fixing element 20 and the latching path 24. In a blocking position of the fixing element 20, the prepositioning element 22 engage, constantly in the further latching path 26.

As soon as the power tool housing 38, due to a pause in the machining of the workpiece, etc., is pivoted in a direction facing away from the bearing unit 44, the prepositioning element 22 or a spring force], acting on the prepositioning element 22, of the spring element 58, moves the fixing element 20 in a direction directed away from the latching path 26 into a release position of the fixing element 20. The stop element 18 is here pivoted by the prepositioning element 22 or a spring force, acting on the prepositioning element 22, of the spring element 58, in a direction directed away from the guide element 28, about the motional axis 36 of the stop element 18 relative to the control element 32. The prepositioning element 22 here remains in contact with the further latching path 26 and prepositions the stop element 18 in a position relative to the guide element 28.

Furthermore, the stop element 16 has at least one guide rail compensation element 66 (FIG. 2). The guide rail compensation element 66 is designed to compensate a distance differential of a bearing surface 68 (FIG. 1) relative to a workpiece surface in a utilization of the portable power tool 12 with a guide rail device (not represented in detail here), in comparison to a utilization of the portable power tool 12 decoupled from the guide rail device. The guide rail compensation element 66 is here mounted on the stop element 18 rotatably about a motional axis 70 of the guide rail compensation element 66, which motional axis 70 runs substantially parallel to the motional axis 36 of the stop element 18. In a utilization of the portable power tool 12 with a guide rail device, because of a rotation of the guide rail compensation element 66 about the motional axis 70 of the guide rail compensation element 66 relative to the stop element 18, a new stop face for the stop region 64 of the power tool housing 38 is provided, which stop face enables a compensation of the distance differential. For a movement of the guide rail compensation element 66, the stop unit 16 has at least one turning lever control element 72 (FIG. 2). The turning lever control element 72 is fixed to the guide rail compensation element 66.

The invention claimed is:

1. A cutting-depth limiting device for portable power tools, comprising:
- at least one cutting-depth guide unit;
- a housing that is pivotably attached to the at least one cutting-depth guide unit, the housing including a stop region; and
- at least one stop unit that is movable relative to the at least one cutting-depth guide unit, the at least one stop unit including:
  - at least one stop element configured to engage with the stop region of the housing;
  - at least one fixing element configured to engage the at least one cutting-depth guide unit in at least one position to fix a location of the at least one stop element relative to the at least one cutting-depth guide unit; and
  - at least one prepositioning element configured to exert a force on the at least one fixing element to bias the at least one fixing element toward a released position of the at least one fixing element.

2. The cutting-depth limiting device as claimed in claim 1, further comprising a guide element that includes at least one latching path, wherein the at least one prepositioning element, in at least one state, is configured to move the at least one fixing element away from the at least one latching path.

3. The cutting-depth limiting device as claimed in claim 2, wherein the at least one prepositioning element is movably mounted relative to the at least one stop element.

4. The cutting-depth limiting device as claimed in claim 3, wherein: the at least on stop unit further includes a control element that is pivotably mounted on the guide element; and the at least on stop element is pivotably mounted on the control element.

5. The cutting-depth limiting device as claimed in claim 4, wherein:
- the guide element further includes a guide recess, and
- the control element is displaceably mounted in the guide recess to enable movement of the at least one stop element.

6. The cutting-depth limiting device as claimed in claim 5, wherein the guide recess is disposed in a plane running at least substantially perpendicular to a motional axis of the at least one stop element.

7. The cutting-depth limiting device as claimed in claim 2, wherein at least the prepositioning element is configured to push directly against the at least one latching path in the at least one state.

8. A portable power tool comprising:
- at least one cutting-depth limiting device that includes:
  - at least one cutting-depth guide unit;
  - a housing that is pivotably attached to the at least one cutting-depth guide unit, the housing including a stop region; and
  - at least one stop unit that is movable relative to the at least one cutting-depth guide unit, the at least one stop unit including:
    - at least one stop element configured to engage with the stop region of the housing;
    - at least one fixing element configured to engage the at least one cutting-depth guide unit in at least one position to fix a location of the at least one stop element relative to the at least one cutting-depth guide unit; and at least one prepositioning element configured to exert a force on the at least one fixing element to bias the at least one fixing element toward a released position of the at least one fixing element.

* * * * *